US006781441B2

(12) United States Patent
Mori

(10) Patent No.: US 6,781,441 B2
(45) Date of Patent: Aug. 24, 2004

(54) VERY SMALL CURRENT GENERATING CIRCUIT

(75) Inventor: Shigenori Mori, Aichi-ken (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/437,453

(22) Filed: May 14, 2003

(65) Prior Publication Data

US 2003/0218496 A1 Nov. 27, 2003

(30) Foreign Application Priority Data

May 14, 2002 (JP) ..... 2002-138080
Feb. 20, 2003 (JP) ..... 2003-043203

(51) Int. Cl.[7] ..... G05F 1/10

(52) U.S. Cl. ..... 327/538; 327/432; 327/478; 323/312; 323/315

(58) Field of Search ..... 327/538–543, 327/512, 74, 76, 427, 478, 480, 432, 433, 482, 108, 103; 323/312, 315; 361/57, 87

(56) References Cited

U.S. PATENT DOCUMENTS 5,557,194 A 9/1996 Kato ..... 323/315
5,760,639 A * 6/1998 Hall ..... 327/539
6,271,710 B1 8/2001 Ooishi ..... 327/538
6,316,990 B1 * 11/2001 Tanizawa ..... 327/538

FOREIGN PATENT DOCUMENTS

| | | |
|---|---|---|
| JP | 6-102355 | 4/1994 |
| JP | 6-332556 | 12/1994 |
| JP | 7-191769 | 7/1995 |
| JP | 9-204773 | 8/1997 |
| JP | 2000-75945 | 3/2000 |

* cited by examiner

*Primary Examiner*—Long Nguyen
(74) *Attorney, Agent, or Firm*—Posz & Bethards, PLC

(57) ABSTRACT

A very small current generating circuit stabilizes a very small current flowing in a CR oscillation circuit and load driving circuit with an over-current protection function wherein, for example, a discharge time period is determined on the basis of the very small current. The very small current generating circuit includes: a first current route wherein between the internal reference voltage terminal and ground, a resistor is connected in series with an npn transistor; a second current route wherein between the external voltage source and ground, another pnp transistor, another resistor, another npn transistor and still another resistor are connected in series in this order; and a third current route wherein between the external voltage source and ground, and another resistor is connected in series with another pnp transistor. The very small current in the first current route is stabilized by the second and third current routes.

9 Claims, 10 Drawing Sheets

VERY SMALL CURRENT GENERATING CIRCUIT

BACKGROUND OF THE INVENTION

1. Field of the Invention

The present invention relates to a circuit for generating a very small electric current.

2. Description of the Related Art

A conventional CR oscillation circuit and load driving circuit with an over-current protection function as shown in FIG. 9 determines a discharge time period on the basis of a very small electric current. As shown in FIG. 9, a pnp transistor 100 is connected in series with a resistor 101 and constant current circuit 102 between a voltage source and ground, while the base of the pnp transistor 100 is connected with the connecting point between the resistor 101 and constant current circuit 102. The above-mentioned series circuit allows a constant current $I_1$ to flow. Further, a pnp transistor 103 is provided between the voltage source and ground, while the base of the pnp transistor 103 is connected with the collector of the pnp transistor 100. Thus, the pnp transistor 103 also allows a very small electric current Ic proportional to $I_1$ to flow.

The CR discharge oscillation circuit as shown in FIG. 10 can be constructed by utilizing the above-mentioned circuit as shown in FIG. 9. The collector (through which Ic flows) of the pnp transistor 103 is connected with transistor 104 which is a part of a current mirror circuit comprises another transistor 105 which is connected with a capacitor 106, thereby constructing through a switch 107 a charging circuit 108. Thus, the discharge current of the capacitor 106 is determined by Ic.

Here, Ic is determined by the following formula, if the transistor 100 has the same characteristics as the transistor 103.

$$Ic=I_1/exp((I_1R_1q/kT)),$$

where $R_1$ is a resistance value of the resistor 101, q is the unit charge of electron, k is Boltzmann constant and T is absolute temperature.

Therefore, it is difficult to stabilize Ic within a whole defined temperature range, because Ic is strongly dependent upon the temperature.

Accordingly, the discharge time period becomes shorter at a higher temperature than at a lower temperature. If the discharge time period is designed for a higher temperature, then the lower temperature discharge time period becomes unduly long.

SUMMARY OF THE INVENTION

An object of the invention is to suppress a fluctuation in the very small electric current (in a small current generating circuit such as a CR oscillation circuit and load driving circuit with an over-current protection function) due to temperature fluctuation, thereby stabilizing the very small current.

The present invention includes several Features stated below.

According to Feature 1, the very small current generating circuit comprises:

a first current route for a first current wherein between an internal reference voltage terminal and a ground terminal, a first resistor 10 is connected in series with a first npn transistor 11 of which collector is connected with said first resistor 10 and of which base is connected with said collector;

a second current route for a second current of a negative temperature characteristics and proportional to said first current wherein between an external voltage source and said ground terminal, a first pnp transistor 12, a second resistor 13, a second npn transistor 14 and a third resistor 15 are connected in series in this order, said second resistor 13 being connected with the collector of said first pnp transistor 12, said third resistor 15 being connected with the emitter of said second npn transistor 14, the collector of said second npn transistor 14 being connected with said second resistor 13, the base of said first pnp transistor 12 being connected with the collector of said second npn transistor 14, the base of said second npn transistor 14 being connected with the collector of said first npn transistor 11; and a third current route for a third current proportional to said second current which is outputted as a very small current wherein between said external voltage source and ground terminal, connected is a second pnp transistor 17 of which base is connected with the collector of said first pnp transistor 12.

Thus, the very small current is stabilized inspite of the temperature fluctuation.

According to Feature 2, the very small current generating circuit further comprises a fourth resistor 16 which is connected between said external voltage source and the emitter of said second pnp transistor 17.

Thus, the current through the third current route is adjusted by the fourth resistor 16.

According to Feature 3, the very small current generating circuit further comprises a fifth resistor 18 which is connected with the emitter of said first npn transistor 11, wherein a temperature coefficient of said fifth resistor 18 is smaller than that of said third resistor 15.

Thus, the slope of the temperature characteristics of the current through the third current route is further adjusted.

According to Feature 4, the very small current generating circuit further comprises a fifth resistor 18 which is connected with the emitter of said first npn transistor 11, wherein a temperature coefficient of said fifth resistor 18 is negative and a resistance value of said third resistor 15 is negligibly smaller than that of said fifth resistor 18.

Thus, the slope of the temperature characteristics of the current through the third current route is further adjusted.

According to Feature 5, in the very small current generating circuit, said internal reference voltage is generated on the basis of a voltage of said external voltage source.

Thus, the current through the third current route is further stabilized due to stabilized internal and external voltages.

According to Feature 6, in the very small current generating circuit, said second resistor 13 comprises a plurality of resistors 30 and 31 with different temperature coefficients.

Thus, the current through the third current route is finely adjusted and less temperature insensitive.

According to Feature 7, the very small current generating circuit further comprises:

a transistor 28 constructing a current mirror circuit;

a transistor 29 constructing together with said transistor 28 said current mirror circuit and provided at an output terminal for outputting said very small current in said third current route;

a capacitor 26 connected with said transistor 28;

a charging circuit connected with said capacitor 26 through a switch 25 for charging said capacitor 26.

Thus, an accurate CR oscillation circuit is constructed due to the stabilized very small current (the current through the third current route).

According to Feature 8, the very small current generating circuit further comprises:

an over-current detecting circuit 23 for switching on said switch 25, when a current through a load 21 becomes greater than a prescribed current;

a comparator 27 for comparing a voltage of said capacitor 26 with a threshold voltage and outputting a signal for switching off a power transistor 20 on the basis of the comparison result.

Thus, a load driving circuit with an over-current protection function is constructed due to the stabilized very small current (the current through the third current route).

According to Feature 9, in the very small current generating circuit, said threshold voltage comprises a lower threshold voltage and a higher threshold voltage.

Thus, the discharge current is stabilized and held within a prescribed range.

Further, the very small current generating circuit of the present invention can be applied to a timer circuit and filter circuit.

PREFERRED EMBODIMENT OF THE INVENTION

Figure 1:
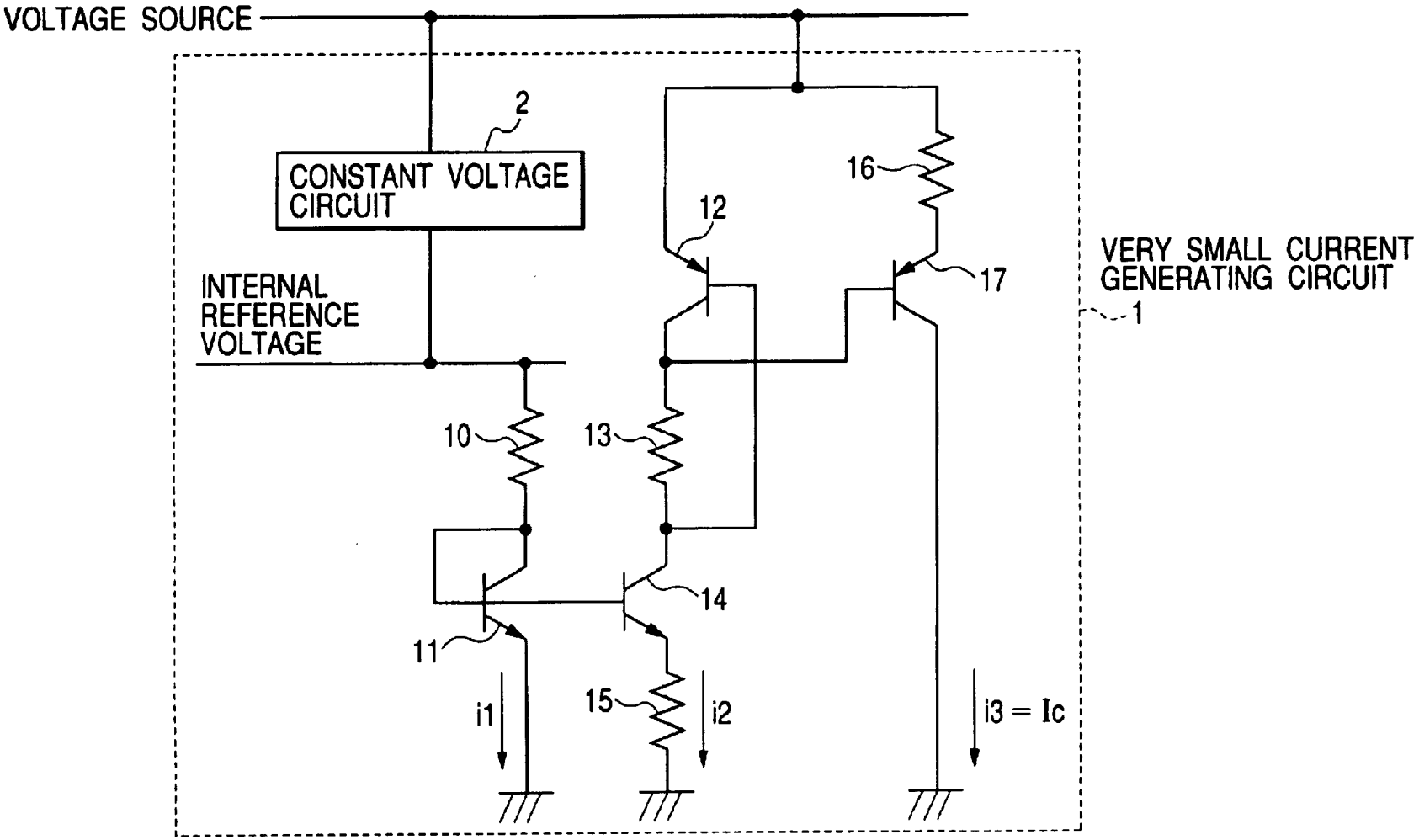
FIG. 1 is a circuit diagram of the very small current generating circuit of a preferred embodiment of the present invention.

Embodiments in accordance with the present invention are explained, referring to the drawings.

FIG. 1 is a circuit diagram of the very small current generating circuit 1 of an embodiment of the present invention.

As shown in FIG. 1, the very small current generating circuit 1 has the constant voltage circuit 2 (connected with an external voltage source of 5 V) which generates 1.2 V as an internal reference voltage which is used as an operation voltage in each circuit in the very small current generating circuit.

Between the internal reference voltage terminal and ground terminal, a first resistor 10 is connected in series with a first npn transistor 11 of which collector is connected with the first resistor 10 and of which base is connected with the collector. A first current $i_1$ of, for example, 100 $\mu$A flows in the above-mentioned series circuit.

Further, between the external voltage source and ground, a first pnp transistor 12, a second resistor 13, a second npn transistor 14 and a third resistor 15 are connected in series in this order. The second resistor 13 is connected with the collector of the first pnp transistor 12, while the collector of the second npn transistor 14 is connected with the second resistor 13, The third resistor 15 is connected with the emitter of the second npn transistor 14. Further, the base of the first pnp transistor 12 is connected with the collector of the second npn transistor 14, while the base of the second npn transistor 14 is connected with the collector of the first npn transistor 11. A second current $i_2$ flowing in the above-mentioned series circuit is proportional to the first current $i_1$ and has a negative temperature-characteristic.

Here, the emitter area of the transistor 14 is made one eighth of that of the transistor 11. Accordingly, the current through the transistor 14 is one eight of that of the transistor 11. Further, it is assumed that the resistance values of the resistors 10 and 15 do not easily fluctuate, even when the temperature fluctuates. Further, the second current $i_2$ is made, for example, 10 $\mu$A by adjusting the emitter areas of the transistors 11 and 14 and the resistance values of the resistors 10 and 15.

Further, between the external voltage source and ground, a fourth resistor 16 is connected in series with a second pnp transistor 17 of which emitter is connected with a fourth resistor 16 and of which base is connected with the collector of the first pnp transistor 12. A third current $i_3$, for example, between 5 nA and 10 nA flowing in the above-mentioned series circuit is proportional to the second current $i_2$ and does not easily fluctuate, even when the temperature fluctuates.

Figure 2:
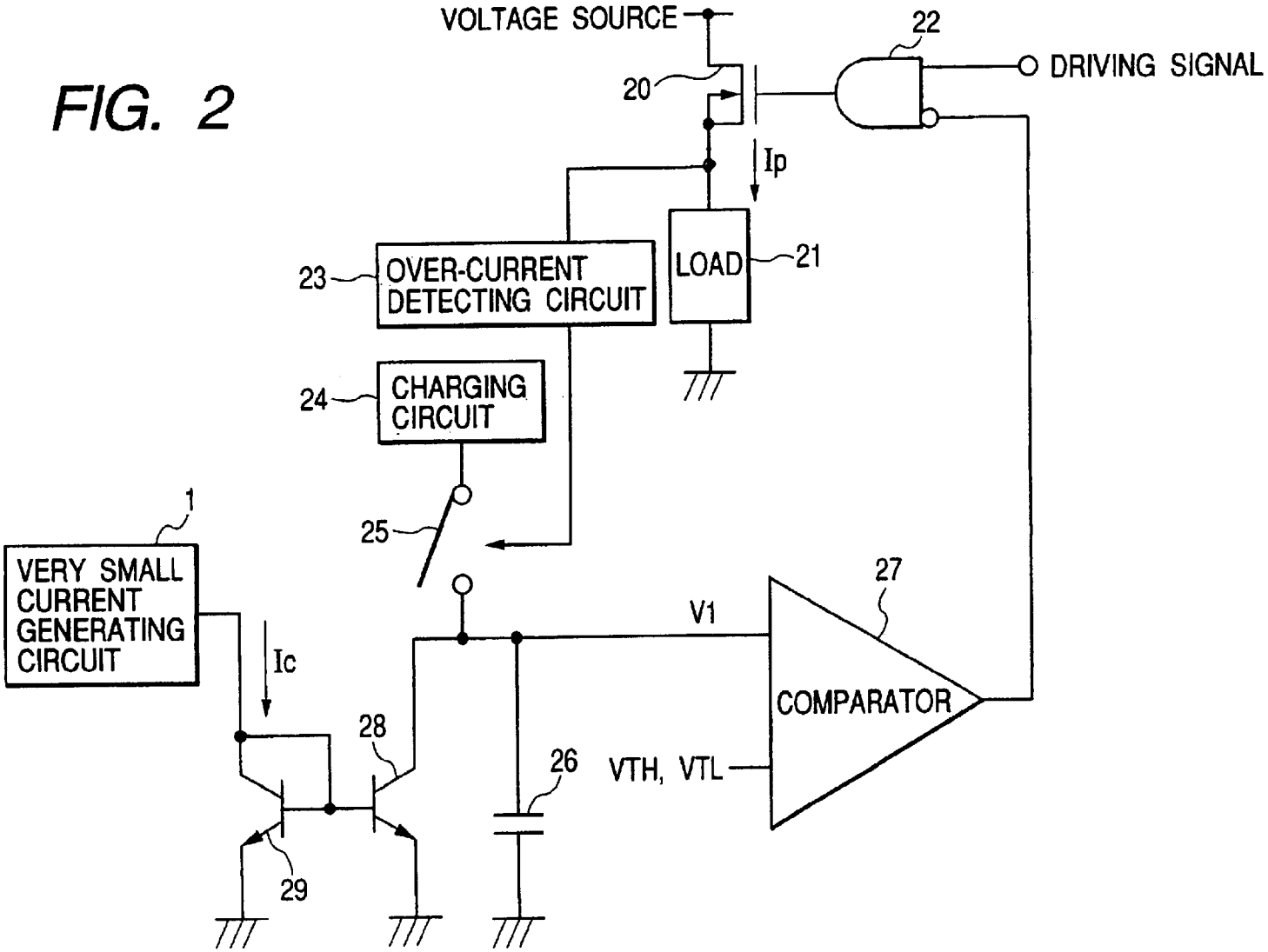
FIG. 2 is a circuit diagram of the load driving circuit with an over-current protection function employing the very small current generating circuit as shown in FIG. 1.

The very small current generating circuit as shown in FIG. 1 is incorporated in a load driving circuit with an over-current protection function which has a power MOS transistor 20 for driving a load as shown in FIG. 2.

As shown in FIG. 2, between a voltage source and ground, the power MOS transistor 20 is connected in series with a load 21. A driving signal is inputted through AND gate 22 into the gate of the power MOS transistor which allows a current to flow in the load 21, when the power MOS transistor 20 is switched on. The over-current detecting circuit 23 detects the current through the load 21 (or the power MOS transistor 20). Further, between a charging circuit 24 (a voltage source terminal) and ground, a switch 25 is connected in series with a capacitor 26. The switch 25 is switched on, when the over-current detecting circuit 23 detects that the current through the load 21 becomes greater than a prescribed current. The capacitor 26 is connected with a comparator 27 which compares a voltage V1 of the capacitor 26 with a threshold voltage of maximum threshold VTH and minimum threshold VHL and outputs on the basis of the comparison result a signal for switching off the power MOS transistor 20.

Further, the capacitor 26 is grounded through a discharge npn transistor 28. Further, a npn transistor 29 is disposed in the current route of Ic in the very small current generating circuit 1. The npn transistors 28 and 29 constructs a current mirror circuit wherein the base of the npn transistor 28 is connected with the base of the npn transistor 29 and the bases are connected with the collector of the npn transistor 29. Accordingly, the npn transistor 29 in the current mirror circuit is provided in the current route for Ic, while the npn transistor 28 in the current mirror circuit is connected with the capacitor 26.

Thus, the charging circuit 24 is connected through the switch 25 with the capacitor 26, while the very small current generating circuit 1 is employed in order to discharge the capacitor 26.

The external driving signal and inverted output from the comparator 27 are inputted into the AND gate 22 of which output is inputted into the gate of the power MOS transistor 20, thereby switching on and off the power MOS transistor 20.

Figure 3:
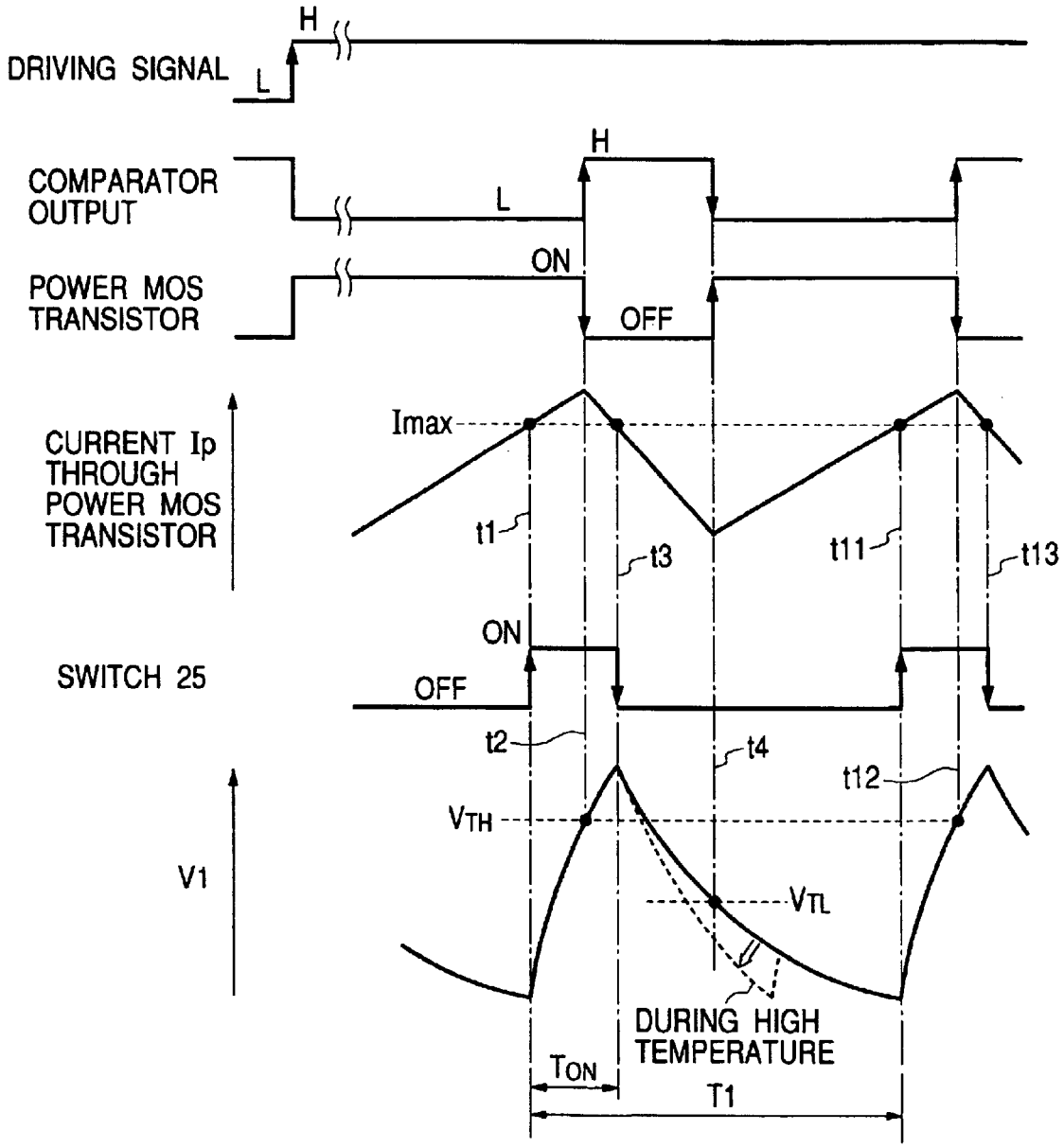
FIG. 3 is a timing chart for explaining the operation of the load driving circuit as shown in FIG. 3.

Next, the operation of the circuit as shown in FIG. 2 is explained, referring to FIG. 3.

FIG. 3 shows the driving signal, comparator output, on/off state of power MOS transistor 20, current Ip through the power MOS transistor, on/off state of the switch 25 and voltage V1 of the capacitor 26.

As shown in FIG. 3, when Ip becomes greater than a prescribed current Imax at a time t1, the switch is turned on, thereby charging the capacitor 26. The discharging current is negligible in comparison with the charging current, because the charging current is made sufficiently greater than the discharging current.

Then, when the capacitor voltage V1 becomes greater than VTH at t2, the comparator output becomes high, thereby switching off the power MOS transistor 20. Thus, the current through the power MOS transistor 20 is limited.

Then, Ip decreases during the off state of the power MOS transistor 20. When the over-current detecting circuit 23 detects that Ip becomes smaller than Imax at t3, the switch 25 is turned off, thereby discharging the capacitor 26. Thus, the capacitor voltage V1 is lowered. When V1 becomes smaller than VTL at t4, the comparator output becomes low, thereby switching on the power MOS 20.

Repeating the above-mentioned cycles, the current through the load 21 (the current through the power MOS transistor 20) is controlled within a prescribed range. Therefore, the load current is stabilized, even when the very small current fluctuates due to the temperature fluctuation.

Figure 9:
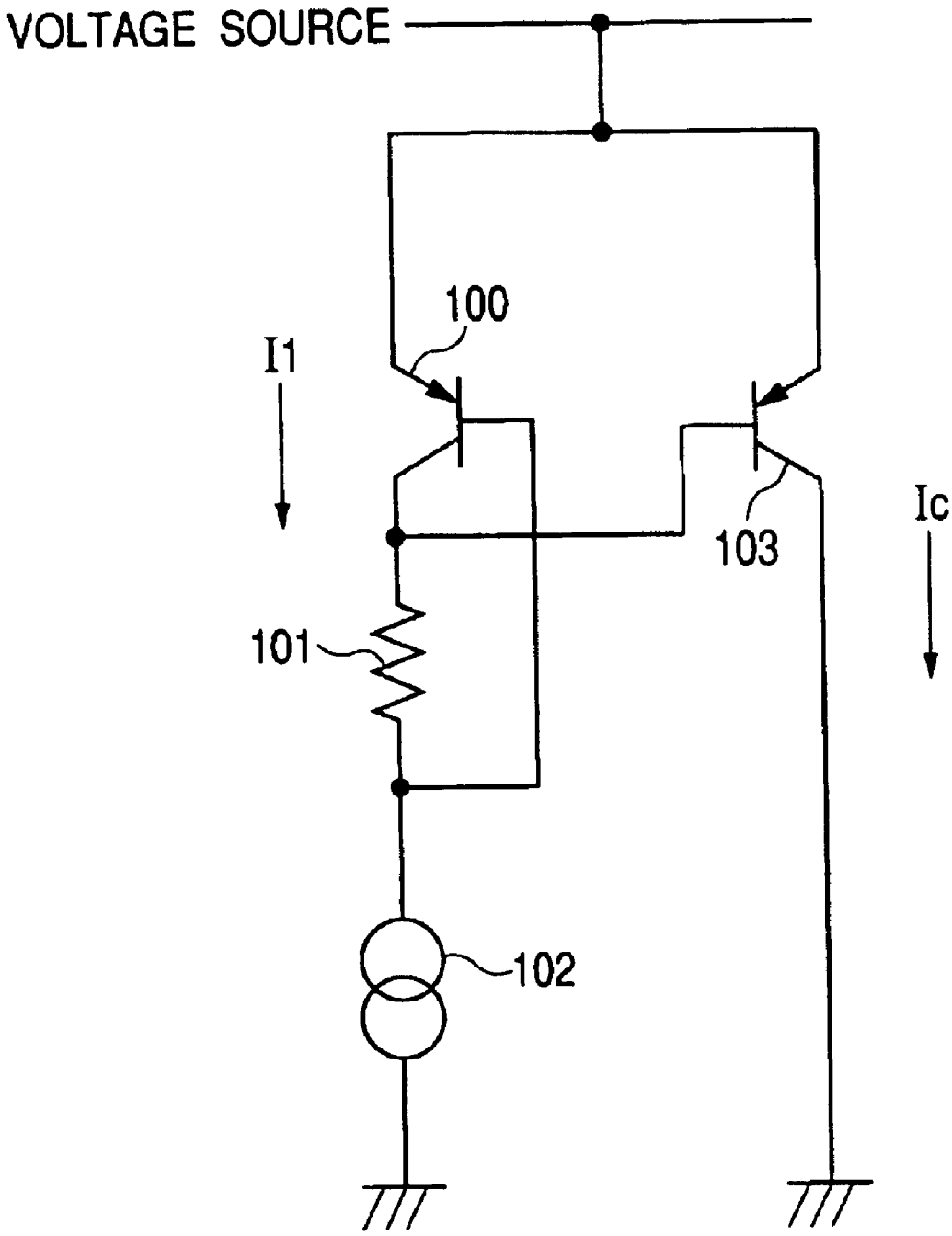
FIG. 9 (PRIOR ART)
FIG. 9 is a circuit diagram of a conventional very small current generating circuit.
Figure 10:
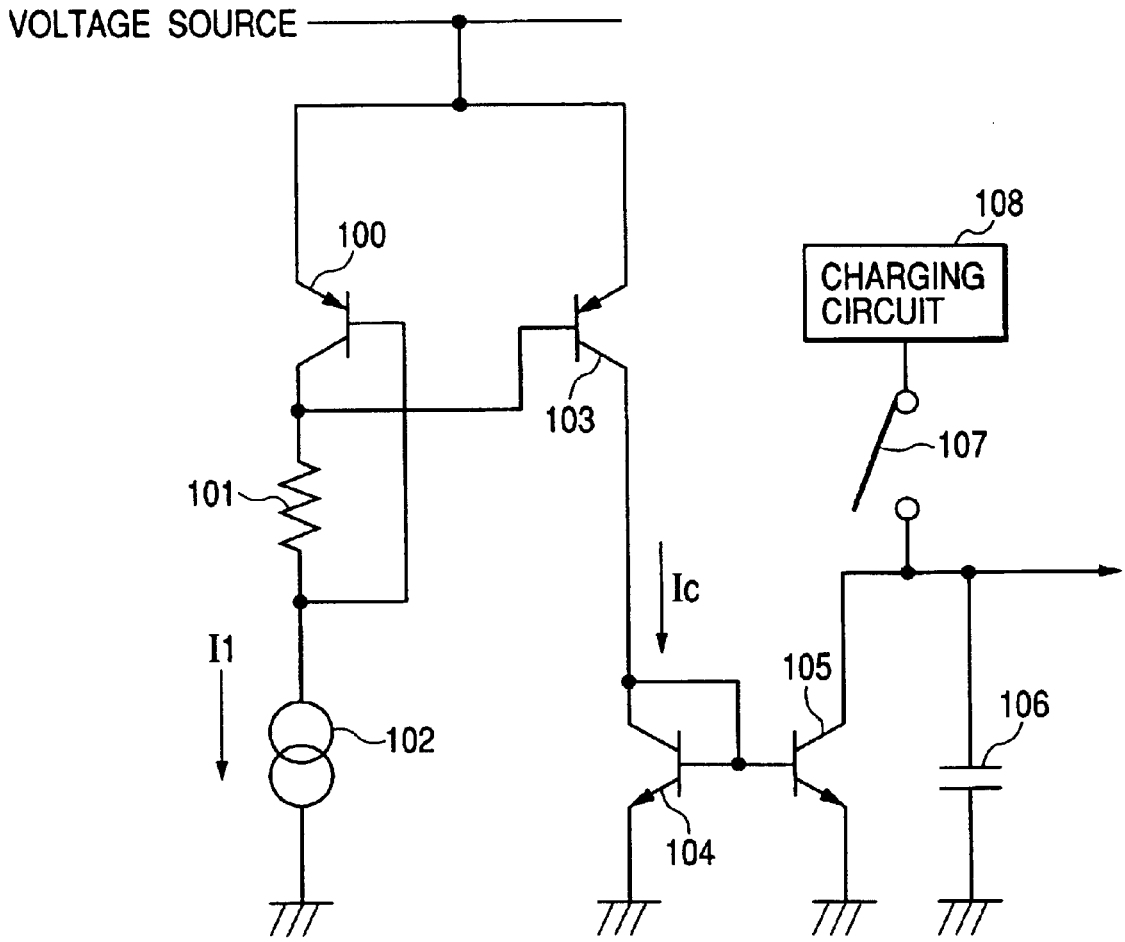
FIG. 10 (PRIOR ART)
FIG. 10 is a circuit diagram of a CR oscillation circuit employing the conventional very small current generating circuit as shown in FIG. 9.

Now, referring to FIGS. 9 and 10, the base-emitter voltage VBE1 of the transistor 103 is expressed by the following formula.

$$VBE1=(kT/q)\ln(I_1/Is1),$$

where Is1 is a reverse collector saturation current.

Further, the base-emitter voltage VBE2 of the transistor 100 is expressed by the following formula.

$$VBE2=(kT/q)\ln(I_1/Is2),$$

where Is2 is a reverse collector saturation current.

On the other hand, $$VBE2=VBE1-R_1\ R_1,$$

where $R_1$ is a resistance value of the resistor 101.

When the characteristics of the transistor 103 are the same as that of the transistor 100, Is1 is equal to Is2.

Then, $$Ic=I_1/exp((kT)/(I_1\ R_1q))$$

Therefore, Ic is strongly dependent upon the temperature, when $I_1$ is constant. The discharge current Ic increases due to the temperature increase, thereby greatly fluctuating a duty ratio of charge/discharge. Concretely, the duty ratio Ton/T1 (ON time is Ton and a cycle time period is T1 as shown in FIG. 3) is increased, when the temperature is raised (cf. the dotted line as shown in FIG. 3). Accordingly, the conventional circuit as shown in FIGS. 9 and 10 has drawbacks regarding both power consumption and heat generation.

Figure 4:
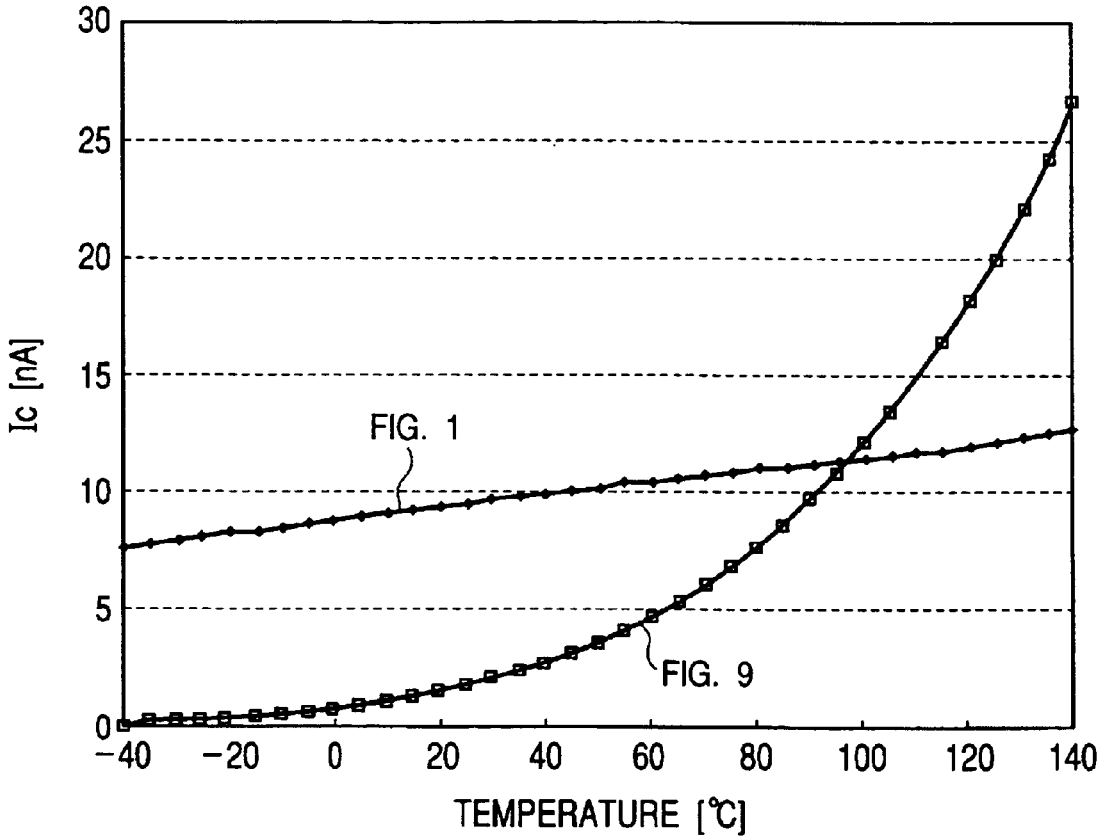
FIG. 4 is a graph showing the temperature characteristics of the circuit of the present invention as shown in FIG. 1 and the conventional circuit as shown in FIG. 7.

On the contrary, according to the circuit as shown in FIG. 1 of the present invention, the duty ratio fluctuation is suppressed in such a manner that Ic fluctuation is suppressed by $i_2$ by using the npn transistors 11 and 14, resistors 10, 15 and 16 and an internal reference voltage insensitive to the operation voltage and temperature. More specifically, the emitter area ratio of the transistor 14 to the transistor 11 is made, e.g., ⅛, in order that the current ratio of $i_2$ to $i_1$ is ⅛. Further, temperature insensitive resistors are preferably selected for the resistors 10 and 15. Further, a slope of the temperature characteristics of $i_3$ (=Ic), i.e., the slope as shown in FIG. 4 as explained below may be adjusted by adjusting the resistance value of the resistor 16.

Thus, the discharging time period is stabilized by suppressing the $i_3$ fluctuation by a negative temperature characteristics in $i_2$.

More specifically, the discharging time period "t" of the capacitor 26 as shown in FIG. 2 is expressed by the following formula.

$$t=Q/Ic,$$

where Q is a charge of the capacitor 26.

Therefore, the fluctuation of "t" is suppressed by the temperature insensitive $i_3$ (Ic) generated by the circuit as shown in FIG. 1.

Thus, in a circuit (such as a CR circuit and load driving circuit with an over-current protection function) which determines the capacitance discharging time period on the basis of the very small current Ic, the circuit operation can be stabilized within a defined whole temperature range by suppressing the Ic fluctuation due to the temperature fluctuation.

FIG. 4 shows Ic dependency upon temperature regarding the circuit as shown in FIG. 1 of the present invention (FIG. 1) and conventional circuit as shown in FIG. 9. As shown in FIG. 4, the Ic fluctuation of the circuit of the present embodiment as shown in FIG. 1 is smaller than that of the conventional circuit.

As already explained, the very small current generating circuit 1 of the present embodiment as shown in FIG. 1 comprises three current routes.

The first current route for $i_1$ is constructed in such a manner that between the internal reference voltage terminal and ground terminal, a first resistor 10 is connected in series with a first npn transistor 11 of which collector is connected with the first resistor 10 and of which base is connected with the collector. Further, the second current route for $i_2$ is constructed in such a manner that between the external voltage source and ground, a first pnp transistor 12, a second resistor 13, a second npn transistor 14 and a third resistor 15 are connected in series in this order. The second resistor 13 is connected with the collector of the first pnp transistor 12, while the collector of the second npn transistor 14 is connected with the second resistor 13. The third resistor 15 is connected with the emitter of the second npn transistor 14. Further, the base of the first pnp transistor 12 is connected with the collector of the second npn transistor 14, while the base of the second npn transistor 14 is connected with the collector of the first npn transistor 11. Thus, $i_2$ flowing in the second current route is proportional to the first current $i_1$ and has a negative temperature characteristic. Further, the third current route is constructed in such a manner that between the external voltage source and ground terminal, the fourth resistor 16 is connected in series with the second pnp transistor 17 of which base is connected with the collector of the first pnp transistor 12. As a result, $i_3$ flowing in the third current route is proportional to $i_2$ and dos not easily fluctuate, even when the temperature fluctuates, thereby stabilizing $i_3$ (=Ic).

Here, the resistor 16 may be omitted from the third current route.

Figure 5:
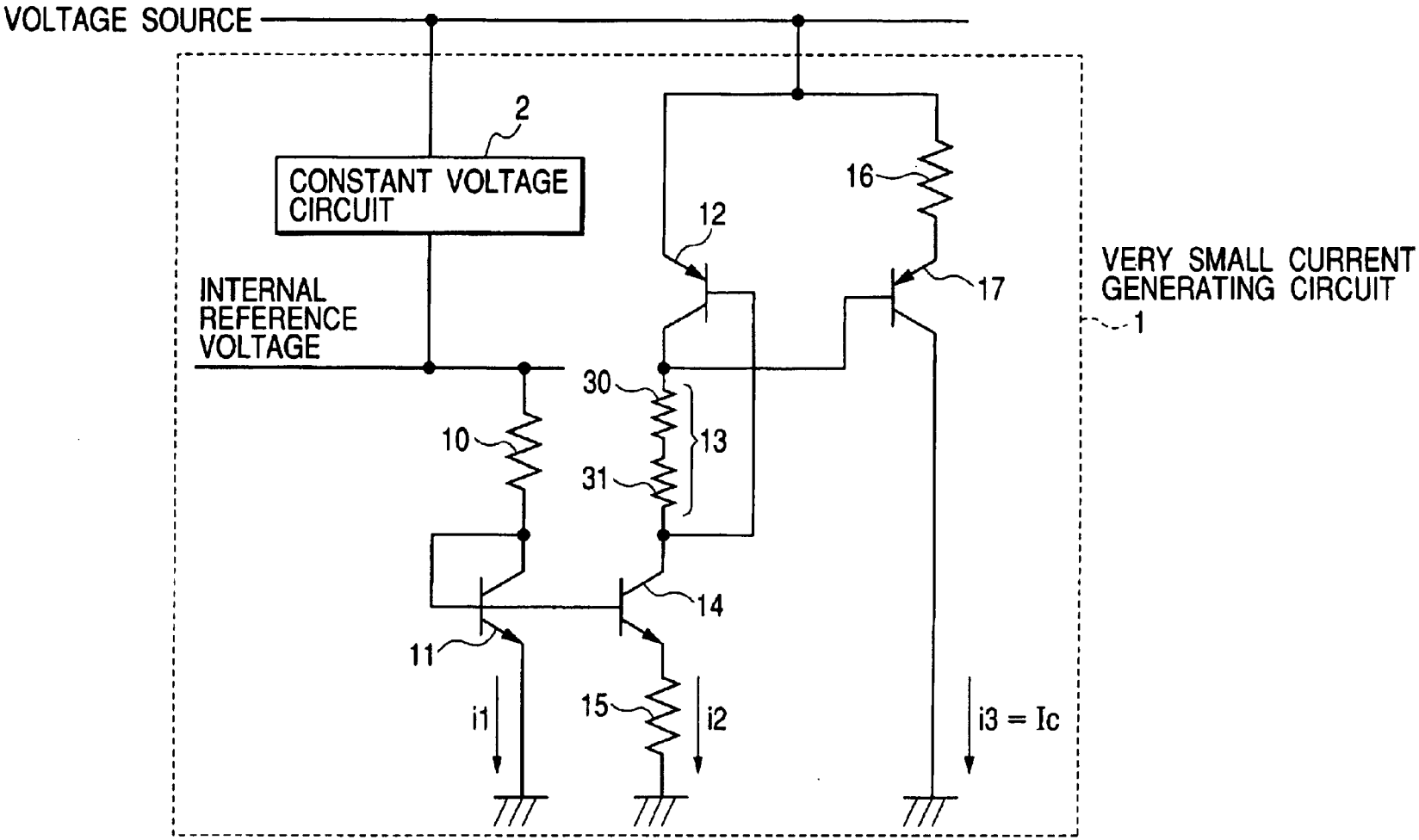
FIG. 5 is a circuit diagram of an improvement of the circuit as shown in FIG. 1.

FIG. 5 is an improvement of the very small current generating circuit as shown in FIG. 1, in order to suppress the small increase in Ic due to the temperature increase as shown in FIG. 1.

Specifically, the second resistor 13 between the pnp transistor 12 and npn transistor 14 is replaced by a plurality of resistors 30 and 31 with different temperature coefficients. The resistors 30 and 31 are selected among different materials with different temperature coefficients such as diffusion resistors and poly-silicon resistors or same materials with different temperature coefficients.

For example, if the temperature coefficient of the resistor 13 is ten, then that of the resistor 30 is 10, while that of the resistor 31 is twenty.

Thus, the temperature characteristic of $i_3$ (=Ic) is improved by selecting the temperature coefficients of the resistors 30 and 31.

Figure 6:
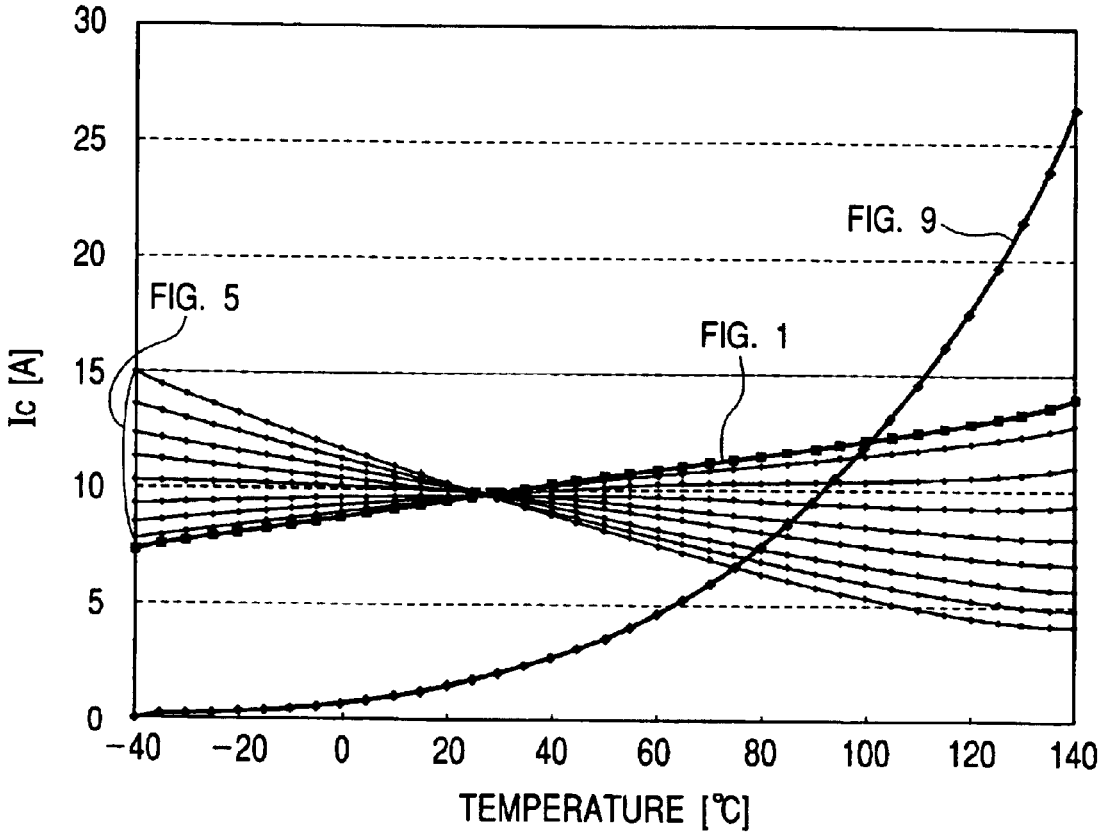
FIG. 6 is a graph showing the temperature characteristics of the circuit as shown in FIGS. 1 and 5 and the conventional circuit as shown in FIG. 7.
Figure 7:
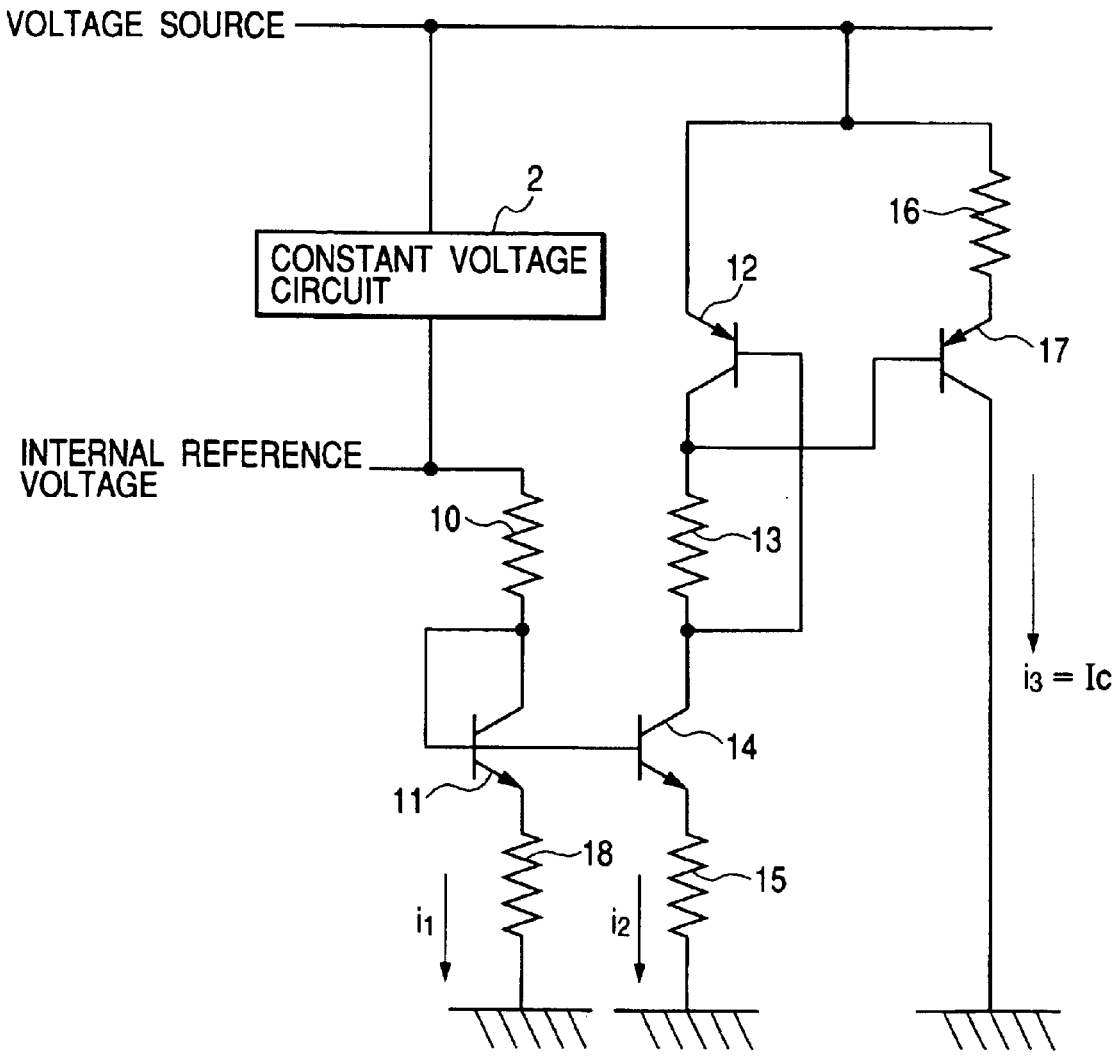
FIG. 7 is a circuit diagram of another improvement of the circuit as shown in FIG. 1.

FIG. 6 shows Ic dependency upon temperature regarding the circuits as shown in FIGS. 1, 5 and 7. As shown in FIG. 6, the Ic fluctuation in the improved embodiment as shown in FIG. 5 is controlled and suppressed by the combination of the resistors 30 and 31.

Further, FIG. 7 is another improvement of the embodiment as shown in FIG. 1. As shown in FIG. 7, a resistor 18 is inserted between the emitter of the first npn transistor 11 and ground terminal. Here, the temperature coefficient of the resistor 18 is made smaller than that of the resistor 15.

Figure 8:
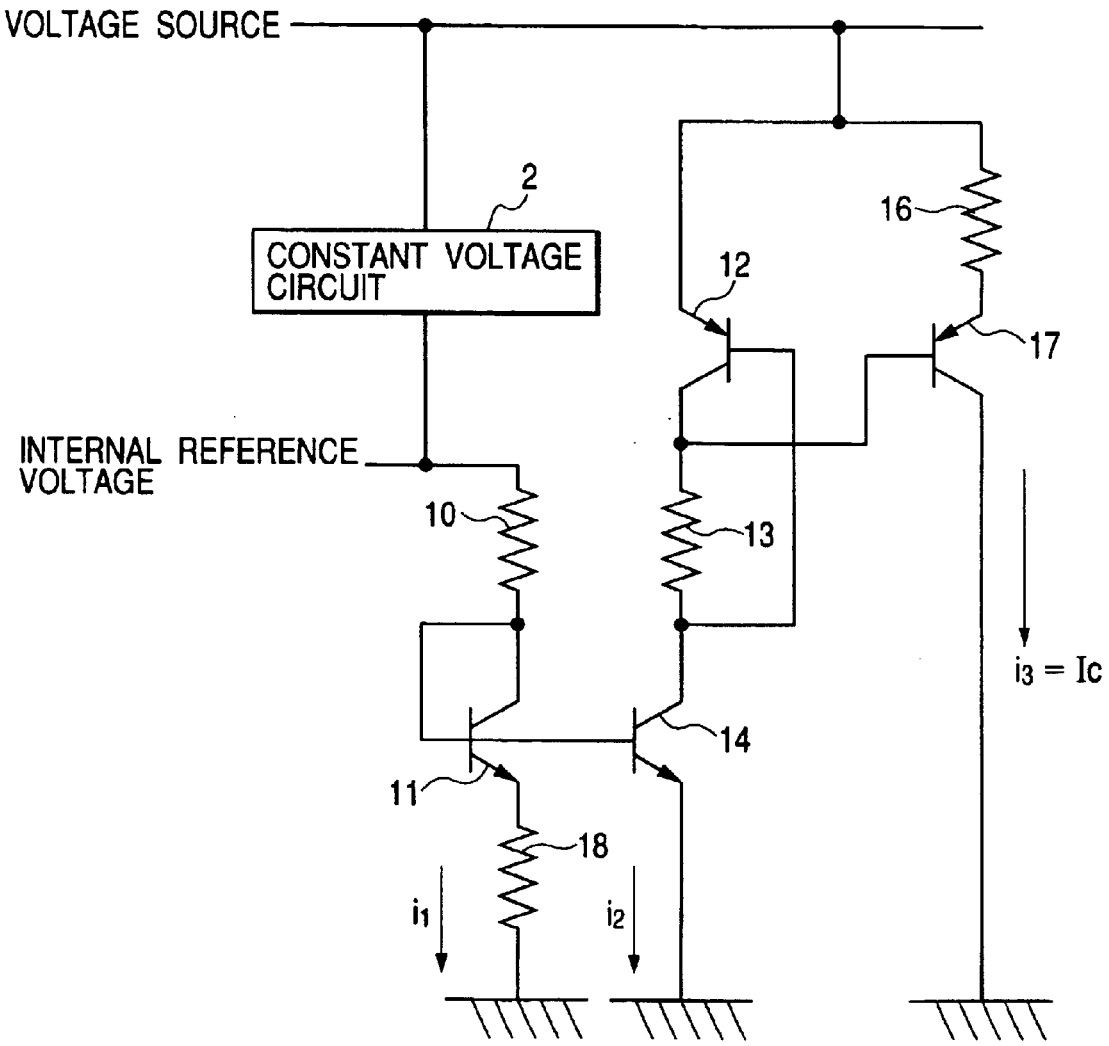
FIG. 8 is a circuit diagram of still another improvement of the circuit as shown in FIG. 1.

Further, FIG. 8 is still another improvement of the embodiment as shown in FIG. 1. As shown in FIG. 8, a resistor 18 is inserted between the emitter of the first npn transistor 11 and ground terminal, while the resistor 15 is omitted or its resistance value is negligibly smaller than that of the resistor 18. Here, the temperature coefficient of the resistor 18 is made negative.

What is claimed is:

1. A circuit comprising:

a first current route for providing a first current wherein between an internal reference voltage terminal and a ground terminal, a first resistor is connected in series with a first npn transistor of which collector is connected with said first resistor and of which base is connected with said collector;

a second current route for providing a second current of a negative temperature characteristics and proportional to said first current wherein between an external voltage source and said ground terminal, a first pnp transistor, a second resistor, a second npn transistor and a third resistor are connected in series in this order, said second resistor being connected with the collector of said first pnp transistor, said third resistor being connected with the emitter of said second npn transistor, the collector of said second npn transistor being connected with said second resistor, the base of said first pnp transistor being connected with the collector of said second npn transistor, the base of said second npn transistor being connected with the collector of said first npn transistor; and a third current route for providing a third current proportional to said second current which is outputted as a very small current wherein a second pnp transistor is connected between said external voltage source and said ground terminal in which the second pnp transistors base is connected with a base of the collector of said first pnp transistor.

2. The circuit according to claim 1, which further comprises a fourth resistor which is connected between said external voltage source and the emitter of said second pnp transistor.

3. The circuit according to claim 1, which further comprises a fifth resistor which is connected with the emitter of said first npn transistor, wherein a temperature coefficient of said fifth resistor is smaller than that of said third resistor.

4. The circuit according to claim 1, which further comprises a fifth resistor which is connected with the emitter of said first npn transistor, wherein a temperature coefficient of said fifth resistor is negative and a resistance resistor value of said third resistor is negligibly smaller than that of said fifth resistor.

5. The circuit according to claim 1, wherein said internal reference voltage is generated on the basis of a voltage of said external voltage source.

6. The circuit according to claim 1, wherein said second resistor comprises a plurality of resistors with different temperature coefficeints.

7. The circuit according to claim 1, which further comprises:

a first transistor;

a second transistor connected with said first transistor to construct a current mirror circuit for mirroring said very small current in said third current route to an output terminal of said current mirror circuit;

a capacitor connected with said transistors; and a charging circuit connected with said capacitor through a switch for charging said capacitor.

8. The circuit according to claim 7, which further comprises:

an over-current detecting circuit for switching on said switch, when a current through a load becomes greater than a prescribed current; and a comparator for comparing a voltage of said capacitors with a threshold voltage and outputting a signal for switching off a power transistor on the basis of the comparison result.

9. The circuit according to claim 8, wherein said threshold voltage comprises a lower threshold voltage and a higher threshold voltage.

* * * * *